United States Patent [19]

Johnson

[11] 4,273,015

[45] Jun. 16, 1981

[54] DOME HEAD PUNCH

[76] Inventor: Donald R. Johnson, 5019 Mortier Ave., Orlando, Fla. 32809

[21] Appl. No.: 44,983

[22] Filed: Jun. 4, 1979

[51] Int. Cl.[3] ..... B26F 1/10

[52] U.S. Cl. ..... 83/670; 83/345; 83/685; 83/686; 83/690

[58] Field of Search ..... 83/670, 669, 684, 685, 83/686, 687, 691, 690, 345, 348

[56] References Cited

U.S. PATENT DOCUMENTS

| | | | |
|---|---|---|---|
| 1,180,102 | 4/1916 | Avery | 83/348 |
| 3,086,411 | 4/1963 | DeLancey | 83/686 X |
| 3,096,015 | 7/1963 | Bradbury | 83/685 X |
| 3,098,406 | 7/1963 | Dodge | 83/685 X |
| 3,194,095 | 7/1965 | Buck et al. | 83/345 X |
| 3,602,080 | 8/1971 | Sickel | 83/670 X |
| 3,657,954 | 4/1972 | Wilkins | 83/348 |
| 4,123,956 | 11/1978 | Harvey | 83/687 X |

FOREIGN PATENT DOCUMENTS

| | | | |
|---|---|---|---|
| 563180 | 5/1957 | Italy | 83/685 |
| Ad.10436 | 4/1914 | United Kingdom | 83/345 |

*Primary Examiner*—J. M. Meister
*Attorney, Agent, or Firm*—Julian C. Renfro

[57] ABSTRACT

A novel punch for employment in a machine utilizing a punch ring containing a number of spaced, radially-arrayed holes in which the punches are secured, with the punch ring being used in cooperative relation with a die ring employing a number of dies corresponding to the number of punches used. During synchronous rotation of the punch ring and the die ring, each punch interacts each time with a corresponding die, with this arrangement making it possible for the edges of a continuous roll of paper or the like destined to be used in a computer or other type of business machine to be rapidly and effectively punched. Although interacting punch and die arrangements are well known, in accordance with this invention I utilize punches that have novel domed heads, with this doming advantageously making it possible for the increment of paper about to be punched to be stretched such that at the time the punch actually enters the die, the stretched piece of paper tends to pop away from the rest of the paper the instant it is punched, thus greatly diminishing the chance of "hangers" being created, which would later tend to impair the action of the computer or business machine in which the paper is employed. The doming of the punches also serves the additional advantages of diminishing the chance that a new punch will be broken during its first encounter with its respective die, and minimizing the friction present between each die and punch combination during normal operation of the machine.

5 Claims, 9 Drawing Figures

DOME HEAD PUNCH

BACKGROUND OF THE INVENTION

The present invention relates to an apparatus for rotarily punching holes in webs of paper or similar material. Punched webs are used quite generally in business machines, calculators, and the like, the web being usually of paper wound in roll formation and having one or both of its side margins perforated throughout the length of the web. The perforations are usually in line formation marginally of the web, and may be equally spaced apart. It is highly desirable that the perforations be accurately formed with clean, sharply cut edges free of burrs, and that the perforating operation be capable of high speed performance without interruption.

It is generally known that best results in the perforating of paper webs is otained by eliminating shearing action between a counter-rotating punch and die arrangement as the web is passed therebetween. That is, the cutting edge of the punch should preferably meet the cutting edge of the die in exact parallelism at opposite faces of the web, so that removal of material at the perforation is instantaneous all around the edge of the perforation, rather than being progressive, as the term shearing is intended to imply. The matter of eliminating shear in perforating paper webs at high speed has been complicated by the fact that high speed operation requires use of the rotary method, which involves feeding the web between oppositely rotating high speed rolls or wheels carrying complimentary radial punches and dies which, by reason of accuracy of the wheel peripheries, are naturally induced to shear rather than press-cut, as the punches roll accurately into the die openings to produce the hole perforations.

Previous efforts to eliminate shear in perforating by the rotary method have included the use of highly complicated and expensive oscillatory mounts for the punches and dies, built into the rolls or wheels which carry them, and actuated by various complex systems of cams, levers, and other mechanical elements geared to the operating mechanism of the apparatus. The prior devices were extremely heavy and expensive, required the employment of intricate parts in great numbers, and were very difficult to service, lubricate, and adjust within the confines of the wheels or rolls. Such devices were subject to many other objections, not necessary to here relate.

It is most essential that the punched holes be not only accurately spaced but accurate in outline. One particular problem has been with respect to "hangers"; that is, incompletely punched out pieces which remain hanging on the web of paper. This is highly objectionable in that it interferes with the operation of high speed computers and expensive business machines; interferes with certain devices which are used for assembling a plurality of sheets after they leave the printing machine; and is objectionable in appearance so that even though the punched holes no longer have any function after they reach the customer, it would be undesirable to leave them in the assembled business forms.

It is conventional when using equipment embodying the shearing principle, to use say ten or more flat headed punches secured to and extending radially from the periphery of a driven roll. Unfortunately, in time these punches become deformed so that a "half moon" elevated ridge is formed on the trailing edge of the punch. Although I do not wish to be limited thereto, I believe that the abnormal elevation formed on the trailing edge portions of the punches is caused by one or more of the following: by shearing contact of the punch with the harder mating die upon leaving the cavity of the latter; abrasion against paper stock; chemicals in the paper and paper coatings; and difference in circumference of the punch ring to the circumference of the die ring.

While the punches themselves are not individually expensive, to replace or refinish them means shutting down the entire printing and punching apparatus for about twenty to thirty minutes say once in about eight hours. This adds up to considerable expense for down time and labor. One previous way of attempting to eliminate this down time was to tap the punches with a hammer to eliminate the "half moon" ridge, but this rapidly resulted in cutting down the length of the punch so that deficient punching resulted.

Another proposed solution relates to a means for continuously leveling or ironing down elevations in the flat headed punches as soon as they occur and while the machine is in operation in a continuous process by what might be described as "policing means." This means comprises an idler roll mounted on an arm secured to a shaft parallel to the shaft which carries the punch roll. The arm is adjustably mounted and in use is adjusted so that the roller which it carries comes in contact with the punches only when the elevation in a surface occurs. However, it can easily be seen that this increases cost and complexity, has non-uniform results, and is a short lived solution.

Other methods have also been employed in order to reduce the frequency of hanging punches, including tool smoothing attachments operatively associated with the basic hole punching machine. Also utilized are supplementary devices known as "ironers," and improved smoothing tools, including hammers and wrenches. Whether they have been as sophisticated and expensive as the former, or as simple as the latter, these tools attempt to flatten out the punch such that it maintains full circular contact with the die as the punch enters and leaves the die cavity. Unfortunately, full circular contact is often not possible with conventional punches, which have flat heads, since the flattened punch often becomes formed in such a manner that a "half-moon" top results.

Various solutions to the foregoing have been proposed, with one being to increase the penetration depth of the flat punch into its cavity. However, this usually results in faster wearing punches with the consequent increase in downtime while the punches are being replaced. It is important to note that the procedure of increasing punch depth does not solve the detrimental shearing action associated with the punch entering the die cavity.

It is to solve the problems associated with the use of conventional flat head punches that I have evolved a novel dome head punch.

SUMMARY OF THE INVENTION

In accordance with this invention, I have provided a novel Dome Head Punch interacting with a complementary die, with such Dome Head Punch greatly improving upon the punching accomplished by prior art arrangements in which flat head punches were used.

As in prior art devices, I use a punch ring, around the periphery of which, a number of my Dome Head Punches are utilized in a spaced relationship. Utilized in cooperative relation with the punch ring is a die ring in which a number of dies corresponding to the number of punches is used. As will be apparent, during synchronous rotation of the punch ring and die ring, each punch successively interacts with the corresponding die.

It is to be realized that at the time replacement punches are installed in the punch ring, they are of somewhat oversized head diameter in that their heads are created to have an outer diameter decidedly larger than the inner diameter of the respective die. Then, at the time each punch initially penetrates its respective die, the peripheral edges of the punch are sheared off so as to bring about a condition in which each punch precisely conforms to its die.

It is important to note that from time to time various users of punches have endeavored to remedy the problem of undesired "hangers" by increasing the penetration distance of the punch into the die by increasing the head height of prior art punches. This had the effect in prior art punches, quite unfortunately, of increasing the tendency for breakage to occur at the time of initial contact between punch and die. This is true because as the head height of a prior art punch is increased, this brings about a substantial increase in the metal around the periphery of the head of the punch, thus substantially increasing the force required to bring about a conformance of the punch to its die.

In contrast, when additional head height is achieved by doming the head in accordance with this invention, very little increase of metal about the periphery of the head of the punch is brought about, thus increasing only very slightly the amount of force required during the initial contact of the punch with its die.

Furthermore, on succeeding penetrations of the punches into their respective dies, fracture of the punches is an increased likelihood in the case of the conventional flathead punch of equal head height in view of its significantly longer contact with the die. Also, on succeeding penetrations, die wear is increased in the case of prior art punches because of increased peripheral surface contact with the longer, straight skirt punch.

Superior results accompany the use of my novel Dome Head Punches in a punch ring in that they each serve to stretch the paper to some extent immediately prior to the punching operation brought about by the interaction of the periphery of the punch with its die. This stretching of the paper by the domed portion of the punch causes the punched disc or "chad" to leave the die in a distinctive movement, thus effectively serving the goal of preventing the chad from clinging to the paper being punched, so that it cannot foul the machines in which it is thereafter used.

It is therefore an object of my invention to provide a novel punch arrangement in which each panel is domed in order to stretch the paper prior to any punching thereof, thus to prevent any chad from remaining on the paper as a "hanger."

It is another object of my invention to provide a domed punch arrangement that effects desirably deep penetration without excessive frictional contact, which penetration assures chad being pushed out in a most effective manner.

It is yet another object of my invention to provide a domed punch in which the novel head configuration inherently minimizes the material disposed around its periphery, thus minimizing the severity of the initial contact of the punch with its die.

These and other objects, features and advantages will become more apparent as the description proceeds.

Figure 6:
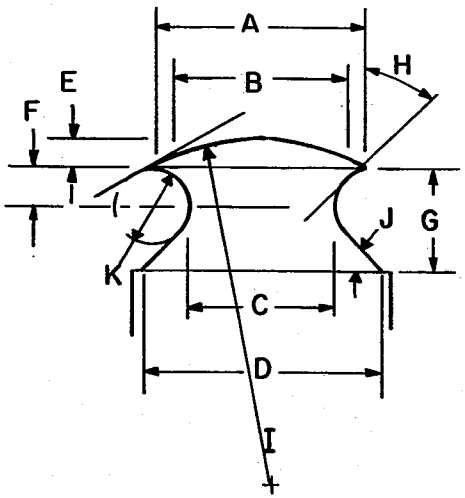
Figure 5:
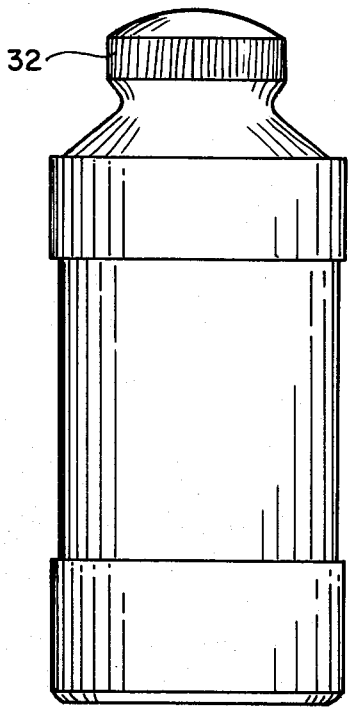
Figure 4:
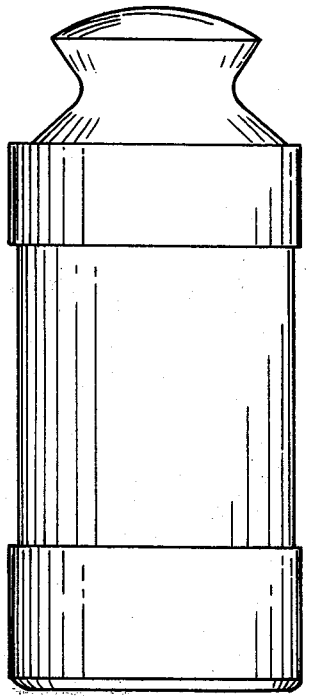
Figures 7, 8, 9:
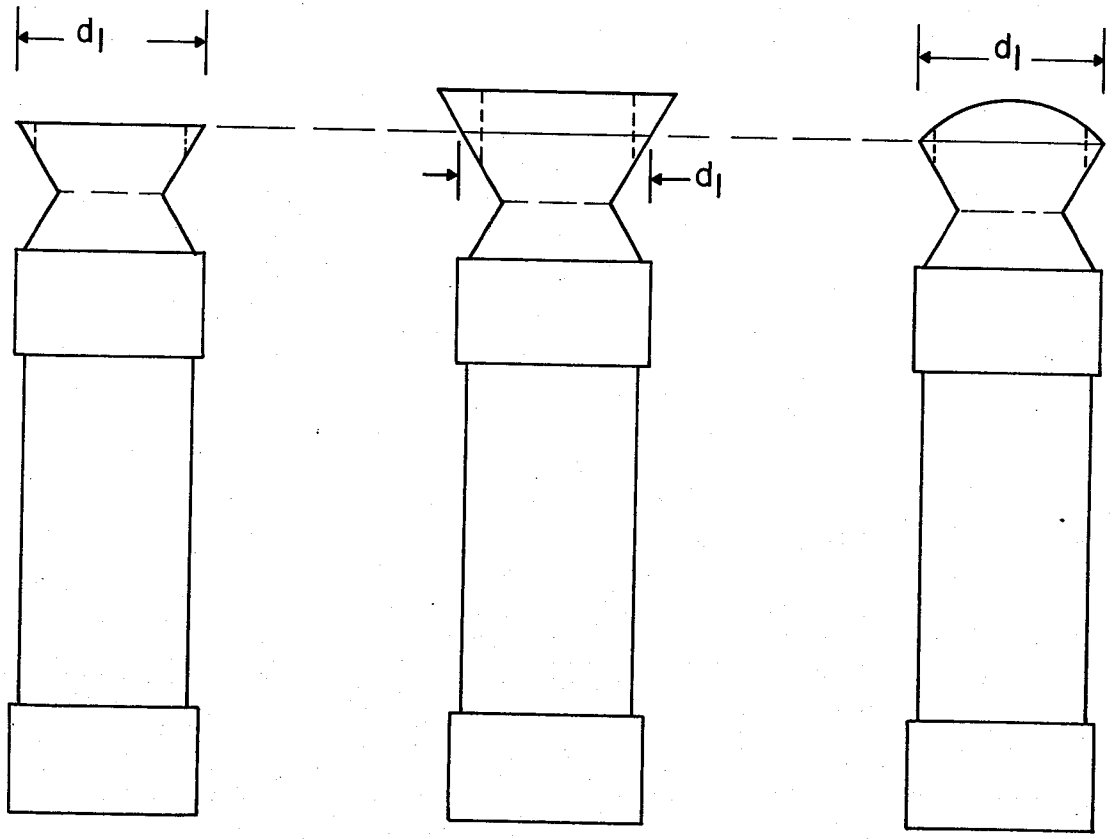
FIG. 8 PRIOR ART
FIG. 7 PRIOR ART

FIG. *3a* is a fragmentary showing of punch and die interaction in accordance with the prior art;

FIG. 4 is a view to a still larger scale of a domed head punch prior to engagement with its die;

FIG. 5 is a view of the punch after engagement with its die;

FIG. 6 is a view revealing the detailed dimensions associated with a typical embodiment of a domed head punch in accordance with this invention; and FIGS. 7 through 9 represent a comparison of two types of prior art punches with the novel domed head punch in accordance with this invention.

DETAILED DESCRIPTION

Figure 2:
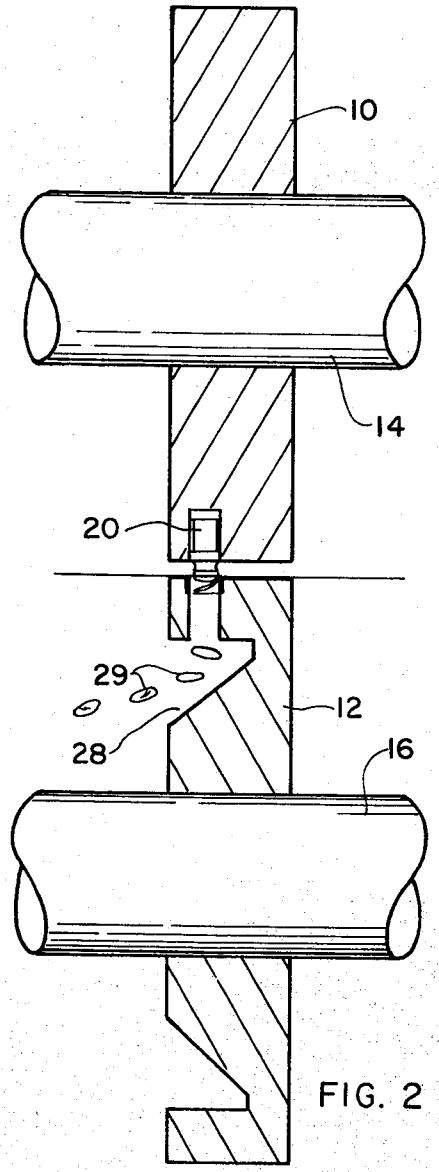
FIG. 2 is a cross-sectional view of the punch and die arrangement of FIG. 1, showing how the punched disks or chad leave the device.
Figure 1:
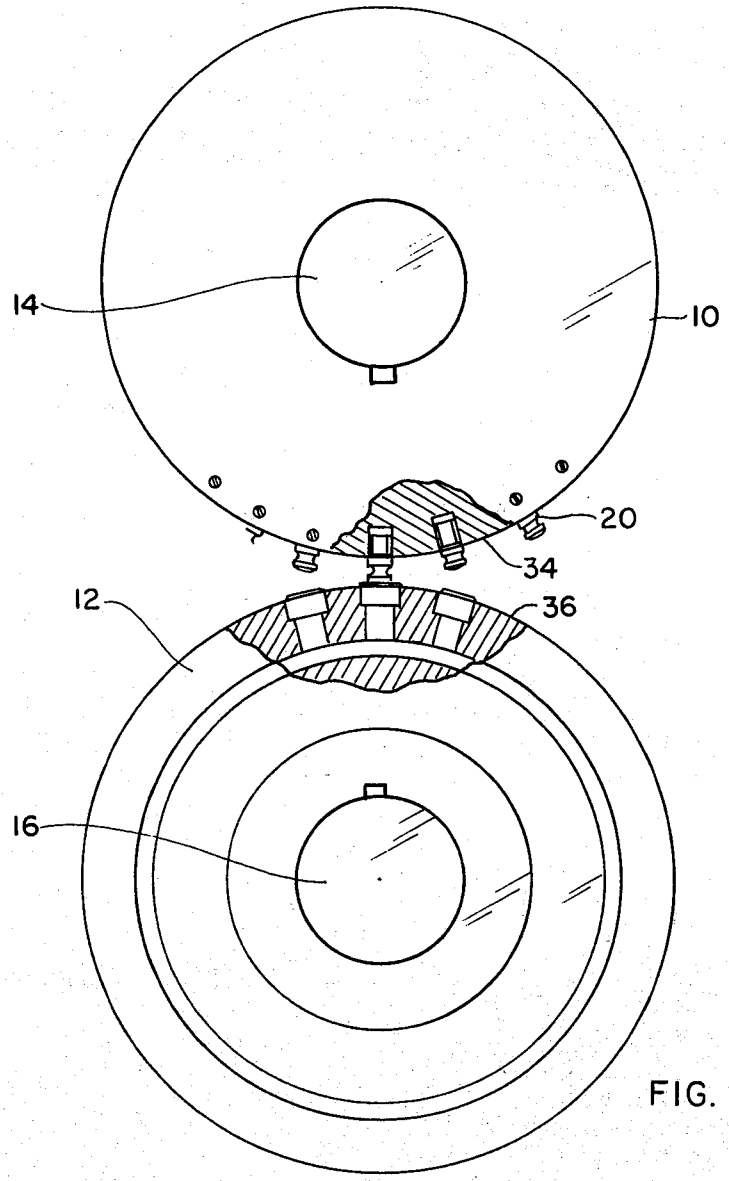
FIG. 1 is a side elevational view of a more or less conventional punch and die arrangement utilized in order that a series of closely spaced holes can be created along the edges of long rolls of paper.

Turning first to related FIGS. 1 and 2, it will there be seen that I have illustrated a more or less conventional punch and die arrangement utilized in order to create a series of closely spaced holes along the edges of long rolls of sheet material, such as paper, with this involving the use of a punch ring 10 and a die ring 12. As will be noted from FIG. 2, the punch ring 10 is rotatably mounted upon a shaft 14, whereas the die ring 12 is mounted upon a shaft 16 that is parallel to shaft 14. The punch ring and die ring turn in opposite directions in a precisely controlled relationship as a result of conventional means (not shown), and it is to be noted that the precise details of latter arrangement are not part of the present invention.

Figures 3, 3A:
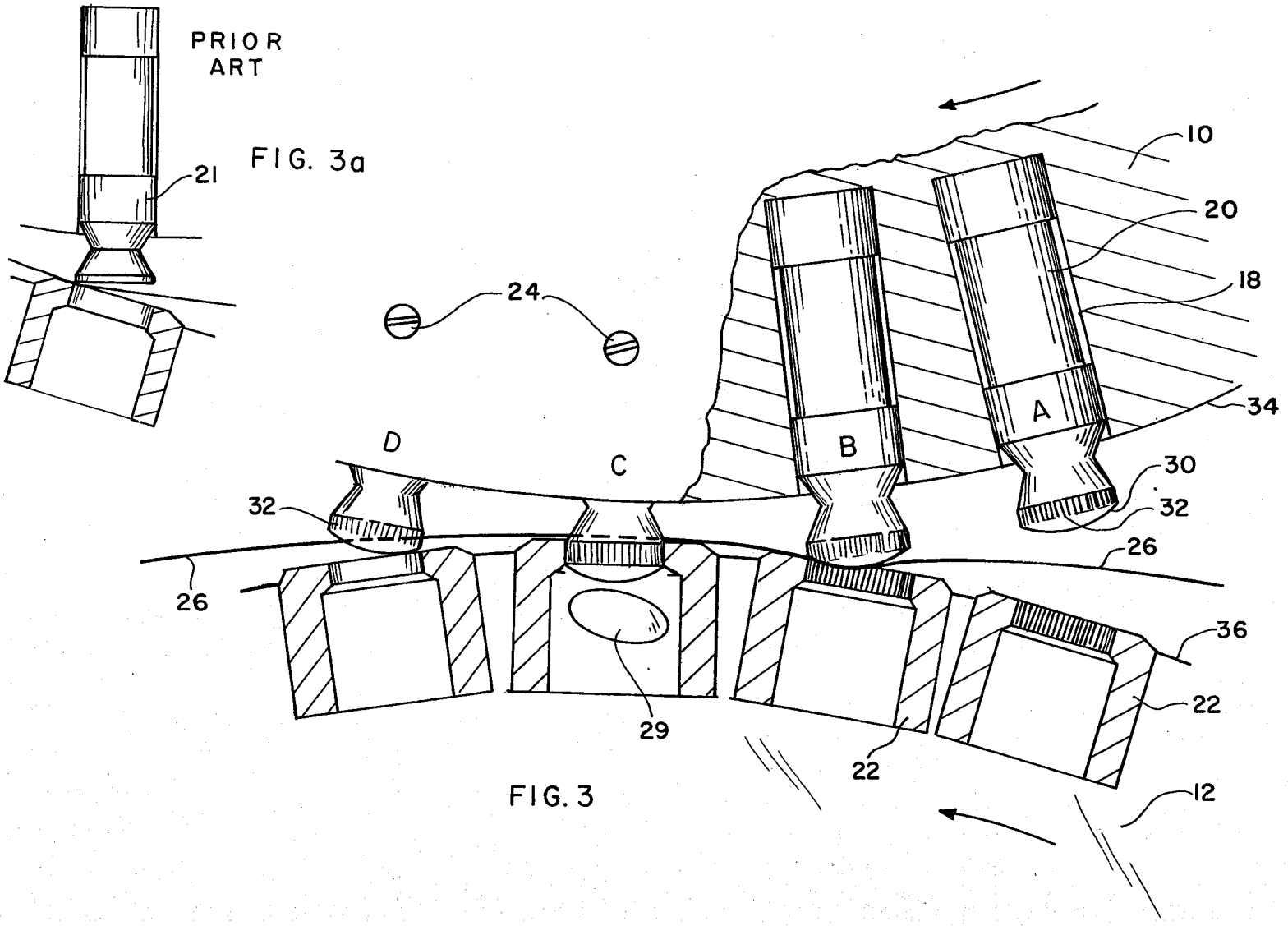
FIG. 3 is a view to a much larger scale showing how my novel domed head punches carried by the punch ring interact with respective dies carried by the die ring in order to bring about the punching of holes in an optimum manner.

As will be apparent from FIG. 1, and to a greater extent in FIG. 3, the punch ring 10 contains a number of novel punch members 20 disposed in an evenly spaced relationship in radially disposed holes 18 disposed about the periphery of the punch ring. As will be noted from FIG. 3, the dome-shaped head portion 30 of each punch member 20 extends to a uniform extent beyond the circumferential surface 34 of the punch ring. A set screw 24 located in the punch ring at the location of each punch member enables the adjacent punch member to be held in its respective hole 18 without slippage.

The die ring 12 is equipped with a number of die members 22, with it to be understood that an important interaction takes place between each punch and its respective die, as will be explained at greater length hereinafter. It is to be noted from FIG. 3 that a web such as of paper 26 passes between the punch ring and the die ring, with the punches 20 serving, by their interaction with respective die members 22, to create a number of evenly spaced holes along the edge of the paper. As will be noted from FIG. 2, a cut away portion 28 created around the inside periphery of the die ring 12 enables chad 29 (also called "confetti") resulting from the punching operation to be effectively discarded.

Turning to FIG. 3, it is to be noted that the die members 22 are of essentially standard construction, with the hole extending into each die member preferably containing serrations. The die members are harder than the respective punch members, so as a result of the initial interaction, the external circumferential surface of the domed head 30 of each punch member takes on serrations 32. Note FIGS. 4 and 5, representing a punch member before and after interaction with the die. Because of the use of an equal number of punch members and die members in the rings 10 and 12, and the precisely controlled relationship under which these members 10 and 12 rotate, there is no problem of the serrations created in a punch member not matching the serrations of the die member with which it interacts during each rotation.

Punches are made of a relatively soft steel, which has excellent machinability. While not limited to an alloy called "Ledloy," this alloy, also known as SAE—12 L14, is generally used. The machinability of this steel is enhanced by the addition of lead during the pouring of the steel, which can be added in the form of fine shot to the steel ingto during the pouring operation. It remains in the solidified steel as a fine dispersion, which acts as a tool lubricant during machining. Lead has little effect on room temperature mechanical properties of steel, and Ledloy steel usually has a hardness of Rockwell "B" 86, which is equivalent to a tensile strength of about 80,000 pounds per square inch. The relative softness of this steel enhances its ability to be sheared as it enters the respective die for the first time.

Turning to FIG. 3, it is to be understood that the punch ring and die ring are rotating in a "meshing" type relationship, in the direction of the arrows, and that the punches shown in this figure are identified as being in positions A through D.

In position A, it will be noted that the domed head of punch member 20 has already been punched in as a result of previous contact with its corresponding die member 22. Disposed between punch and die is a web of sheet material 26 such as paper that is to be punched as a result of co-rotation of the punch and die rings.

In position B of FIG. 3, it will be noted that the dome head portion 30 of the punch has entered the die cavity before any punching action commences. It is during this entering, and prior to metal-to-metal contact between the punch and die, that the web of sheet material is stretched, thus effectively causing the punched portions to leave the sheet material.

In position C, the dome head punch and the respective die are in complete contact, and the dome head portion extends beyond the serrations of the die, thus ensuring that the chad 29 is completely punched through. As previously mentioned with regard to FIG. 2, because of the cut away portion 28, the chad or confetti is discarded in such a manner as not to be included with the paper 26, which of course would impair the action of a computer or other machine in which the paper is therafter to be utilized.

It will be noted that in position D of FIG. 3, the dome head punch and die are tangential at the point of disengagement while the dome portion 30 is still somewhat within the die, thus promoting a circumferential contact removal rather than a scissors type cutting action removal that characterizes the prior art, which promoted the chad hanging onto the holes.

By way of providing an increased awareness of the punching action involved in accordance with the prior art, I have provided a FIG. **3*a* in which the prior art punch 21 is provided with a flat head, with the head of this prior art punch being in a comparable position to its die as is involved in position B in FIG. 3. Whereas in FIG. 3, the dome of the punch brings about a decided bulging of the paper as a result of the dome portion contacting the paper prior to the punching action, in contrast, in FIG. 3*a* the flat head punch has already started cutting the paper, with manifestly no stretching of the paper being brought about in view of the absence of any dome. It is therefore to be seen that quite unlike the present invention, where there is a definite tensioning of the paper as a result of the contact with the domed portion of the punch, in FIG. 3*a*** the piece of paper to be punched, may easily remain in its prepunched location. As a result, the paper is sheared gradually during the increased contact between the prior art punch and the die, with the punch being retracted very shortly thereafter from the die and with there being little if any tendency for the chad or punched portion to move out of the die.

Turning to FIGS. 4, 5 and 6, it is to be noted that FIG. 4 represents to an enlarged scale, the appearance of a domed head punch before engagement with its respective die, whereas FIG. 5 represents the punch after its head has taken on serrations as a result of interaction with its respective die. Although FIG. 5 represents the appearance of the dome head punch in its operative condition, it nevertheless is more convenient to discuss my novel dome head punch with the head unsheared, and with certain dimensions applied thereto, as shown in FIG. 6.

Although punches in accordance with my invention can be used for punching holes of a variety of sizes ranging from say ⅛" diameter to ½" in diameter, I have chosen a set of dimensions corresponding to the second punch size shown in appended Table I.

Although I an not to be limited to any particular set of dimensions, in FIG. 6 I have set forth several letters associated with certain key dimensions and angles of my novel punch. One set of dimensions typical for a satisfactory punch corresponds to the letters as follows:

| | | | | | |
|---|---|---|---|---|---|
| A | .185 / .181 | inches | F | .037 | inches |
| B | .156 | inches | G | .090 | inches |
| C | .132 / .128 | inches | H | 45° | |
| D | .210 | inches | I | .200 | inches radius |
| E | .025 | inches | J | 45° | |
| | | K | .032 | inches radius | |

Obviously, other dimensions, tolerances and radii could be used within the spirit of this invention.

Before interengagement between the punch and die, the diameter of the circumferential head portion of the punch in FIG. 6 may be approximately 0.185 inches; after the punch has been sheared, the diameter may be approximately 0.156 inches.

As should now be apparent, my novel domed head punch is highly advantageous in that it stretches the paper for a tangible amount prior to the time the punch and die interengage in order to bring about a punching operation. Because of the prestretching of the paper, the chad leaves the die with a distinctive movement, which greatly diminishes the likelihood that the chad will cling to the paper web subsequent to the punching operation.

Turning now to appended Table I, it will be noted that I have shown six different punch sizes ranging from diameters of $\frac{1}{8}$ inch to $\frac{1}{2}$ inch, and the dome height h typical for each size punch. Actually, Table I provides certain additional information in that it also specifies a diameter $d_i$ representing the presheared punch diameter, the radius r of the dome, and the rise angle $\theta$ of the dome.

TABLE I

| | $d_1$ Presheared Punch Dia. inches | $d_2$ Punch size (Actual Dia. of Punched Hole) inches | h Maximum Height of Dome inches | r Radius of Dome inches | $\theta$ Rise Angle |
|---|---|---|---|---|---|
| 1. | .152 | .125 | .021 | .19 | 30° |
| 2. | .183 | .156 | .025 | .20 | 30° |
| 3. | .214 | .187 | .029 | .21 | 30° |
| 4. | .277 | .250 | .037 | .24 | 30° |
| 5. | .402 | .375 | .053 | .37 | 30° |
| 6. | .527 | .500 | .069 | .51 | 30° |

I have found that the ratio of the presheared punch diameter $d_1$ to dome height h should be between 7 and 8 in most instances, although the ratio could range between 6 and 9 in other instances. As an example, for a punch of a diameter $d_1$ of 0.183, Table I reveals the maximum dome height h to be 0.025. Expressing the ration mathematically.

$$d_1/h = 0.183/0.025 = 7.32$$

Turning to FIGS. 7, 8 and 9, it will be noted that I have shown three punches with their heads in a definite, pre-established relationship to a datum plane, which is provided in order to simplify the understanding of the amount of shearing of a punch head that must take place at the time of initial contact between the punch and die.

In FIG. 7 it is to be seen that the head of this prior art punch is flat, and the sides of the head portion possess a definite "coke bottle" configuration. By the vertical dashed lines in this figure, I indicate the approximate amount of metal that must be removed around the periphery of the head at the time of initial contact of the punch and die. If breakage of the punch occurs at the time of initial contact, the placement of the machine back on the line must be delayed until the punch is again replaced, and the replaced punch survives the initial contact with the die.

In FIG. 8 I show a prior art punch resembling FIG. 7 in every way except that the flat head rises above the datum plane, which would be the approximate head configuration if the user endeavored to minimize the problem with "hangers" by increasing the penetration of the ordinary, prior art flathead punch into the die. Because the sides of the head portion of the punch flare upwardly and outwardly as depicted in FIG. 8, it will be quickly seen that the increase in head height causes a substantial increase in the metal that must be sheared from around the periphery of the head of the punch at the time of initial contact with the corresponding die. A comparison of the metal located outwardly of the vertical dashed lines in FIG. 8 with the metal outwardly of the vertical dashed lines in FIG. 7 clearly reveals the considerably increased amount of metal to be removed from the punch at the time of initial contact with its die. Quite clearly it may be deduced that breakage of the punch will much more likely take place in the instance illustrated by FIG. 8 in view of the substantially larger amount of metal that must be removed by the die from the periphery of the head.

Turning to FIG. 9, it will be noted that the same rise above the datum plane is achieved by the novel domed head punch of this figure, as compared with the punch of FIG. 8, but because of the fact that the head is cut at a spherical radius rather than being cut flat, the amount of metal disposed about the periphery of the head of the punch of FIG. 9 will be vastly decreased. In other words, a considerable percentage of the metal located outboard of the dashed lines and above the datum plane in FIG. 8 has been eliminated by doming, which of course means that very little additional force is required to bring about the shearing of the head of the punch of FIG. 9 at the time of initial contact between the punch and die.

I claim:

1. A novel domed head punch adapted for use on the periphery of a rotary punch ring of a machine that also utilizes a die ring rotating at the same speed at a location closely adjacent the punch ring, the head of said punch being arranged to enter a corresponding serrated die on the die ring during co-rotation of the punch ring and die ring, and during such entry, having penetrating contact with the serrations of the die, thus to effect the punching of holes in sheet material passing between the punch and die, the domed head of said punch causing somewhat of a stretching of the sheet material residing adjacent the die immediately prior to the punching of the sheet material by the punch and die, with this stretching of the sheet material causing the punched portion to readily leave the main portion of the sheet material passing between punch and die, thus diminishing the likelihood of "hangers" being created.

2. The novel domed head punch as defined in claim 1 in which a multiplicity of punches each having a domed head are used at spaced locations on the periphery of the punch ring, with each domed head punch interacting with a certain die of the die ring.

3. The novel domed head punch as defined in claim 1 wherein the diameter of the head portion of the punch is of a dimension approximately six to eight times larger than the dimension represented by the height of rise of the dome.

4. In a machine utilizing a punch ring and a die ring rotatable in a cooperative relationship wherein punches of the punch ring interact with serrated dies of the die ring such that a series of spaced holes can be punched in sheet material passing therebetween, the improvement comprising the use of a series of novel domed head punches disposed in spaced relation about the periphery of the punch ring, each of said punches having a head portion adapted during co-rotation of the punch ring and die ring to enter a respective serrated die, and during such entry, having close contact with the serrations of the die, the head portion of each punch having a diameter approximately six to eight times the height of rise of its dome, with the domed head of each punch having the effect of stretching the sheet material immediately prior to the engagement of punch and die that results in a hole being cut in the sheet material, the stretching of the sheet material immediately prior to the punching thereof diminishing the chance of the punched portion remaining attached to the rest of the sheet material.

5. The machine as defined in claim 4 wherein the diameter of the head of each punch is of a dimension approximately six to eight times larger than the dimension represented by the height of rise of the dome.

* * * * *